US011612038B1

(12) United States Patent
Lee

(10) Patent No.: US 11,612,038 B1
(45) Date of Patent: Mar. 21, 2023

(54) BOOST VOLTAGE DRIVING DEVICE

(71) Applicant: Wen-Sung Lee, Taichung (TW)

(72) Inventor: Wen-Sung Lee, Taichung (TW)

( * ) Notice: Subject to any disclaimer, the term of this patent is extended or adjusted under 35 U.S.C. 154(b) by 0 days.

(21) Appl. No.: 17/745,846

(22) Filed: May 16, 2022

(51) Int. Cl.
*H05B 47/10* (2020.01)

(52) U.S. Cl.
CPC ..... *H05B 47/10* (2020.01)

(58) Field of Classification Search
CPC ..... H05B 47/10
See application file for complete search history.

(56) References Cited

U.S. PATENT DOCUMENTS 10,804,803 B1 * 10/2020 Couleur ..... H02M 3/1584
2021/0144836 A1 * 5/2021 Krajnc ..... H05B 47/175
2022/0046778 A1 * 2/2022 Leung ..... H05B 45/10

* cited by examiner

*Primary Examiner* — Minh D A

(57) ABSTRACT

A boost voltage driving device is provided, in which the boost voltage driving device is electrically connected to a light emitting device, and drives the light emitting device. The boost voltage driving device includes: an electric power supply module, a microcontroller, a boost voltage module, a first feedback circuit and a second feedback circuit.

6 Claims, 1 Drawing Sheet

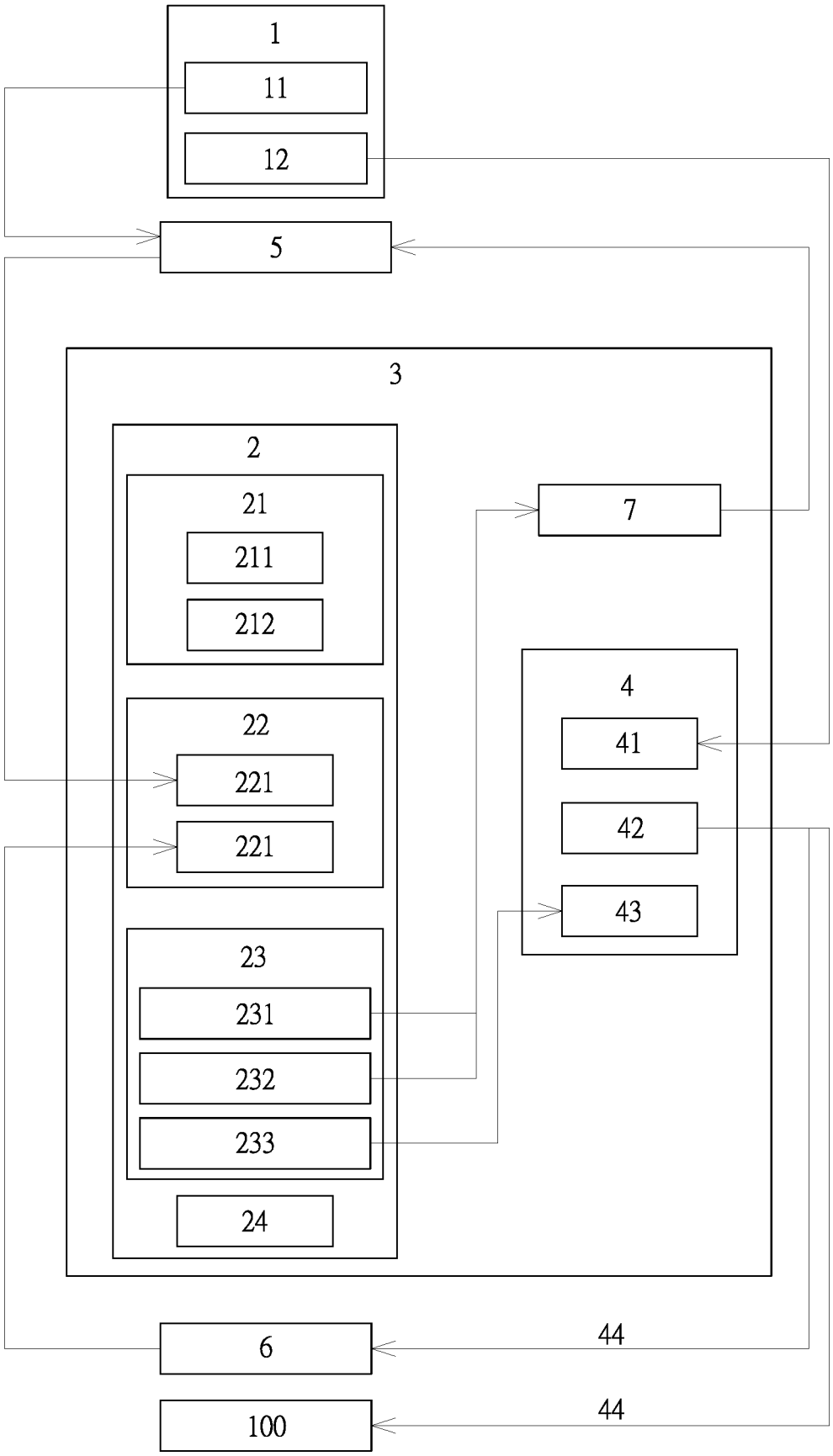
1
11
12
5
3
2
21
211
212
22
221
221
23
231
232
233
24
7
4
41
42
43
6
44
100
44

BOOST VOLTAGE DRIVING DEVICE

FIELD OF THE DISCLOSURE

The present disclosure relates to a boost voltage driving device, and more particularly to a power supply device used in the field of small lighting products, mainly to control the power output effectively and accurately, so that the service life of the small lighting products can be maintained without shortening.

BACKGROUND OF THE DISCLOSURE

In general, most of the electric power supply sources of the light-emitting products are dry cells, lithium batteries, etc. The above-mentioned power supply sources can only output a fixed current, which cannot provide the light-emitting products to produce extremely high brightness since some light-emitting products require large current, therefore a boost voltage circuit device will be provided in the light-emitting products.

However, the output voltage of the ordinary boost voltage circuit device should be larger than the input voltage to be functional, which indirectly causes that the use time of the light-emitting product cannot be balanced due to the increase of the current when the power is supplied, which shorten the battery life and even affect the brightness of light-emitting products, as disclosed in Patent No. TWI527497, entitled "Driving system of LED and control module."

Although the above-mentioned patent solved the problem by changing the pulse width, the changed pulse width still maintains a fixed bandwidth, and the system cannot be changed according to the strength of battery power, the strength of light, and the time requirement of lighting. Moreover, due to the fixed electric power, bandwidth and frequency, the battery service life will be shortened faster when supplying products with high-intensity light lumen, especially to the products with the booster circuit, which will even affect the light intensity of light-emitting products.

SUMMARY OF THE DISCLOSURE

The main objective of the present disclosure is to effectively and accurately control the output of electric power of the light emitting products, and thereby maintain the service life of the light emitting products, and improve the frequency bandwidth of the output power. In the conventional technology, the output power can only be limited to a fixed frequency bandwidth, and cannot be effectively adjusted and precisely controlled, resulting in a shortened service life of the power supply device, and even affecting the light intensity of the light-emitting product.

In order to achieve the objective and the advantage mentioned above, the present disclosure provides a boost voltage driving device, electrically connected to and driving a light emitting device, wherein the boost voltage driving device includes: an electric power supply module, outputting alternating current or direct current; a microcontroller, mounted on a circuit board and electrically connected to the electric power supply module; in which, the microcontroller further includes a control unit, receiving the alternating current from the electric power supply module; an input unit, adjusting, converting, or changing the voltage, pulse width and frequency of the power; and an output unit, outputting the power from the control unit; a boost voltage module, mounted on the circuit board and electrically connected to the electric power supply module and the microcontroller, wherein the boost voltage module includes a receive unit, a transmit unit and a boost voltage control unit; wherein, the receive unit receives the power from the output unit and directly receives the direct current from the electric power supply module; wherein the power is adjusted by the boost voltage module to adjust the duty cycle and bandwidth to obtain a boosted voltage power, and the boosted power is transmitted to the light emitting device by the transmit unit and drives the light emitting device to emit light; a first feedback circuit as an electrical connection between the electric power supply module and the microcontroller; and a second feedback circuit as an electrical connection between the boost voltage module and the microcontroller.

When the electric power supply module outputs alternating current, the power is transmitted to the first feedback circuit and progress gain and distortion suppression, then transmitted to the microcontroller; when the electric power supply module outputs direct current, the power is directly transmitted to the boost voltage module and adjusted by the boost voltage module to obtain the boosted power, part of the boosted power is transmitted to the second feedback circuit for gain and distortion suppression and then transmitted to the microcontroller, and part of the boosted power drives the light emitting device.

BRIEF DESCRIPTION OF THE DRAWINGS

The described embodiments may be better understood by reference to the following description and the accompanying drawing in which:

FIG. 1 is a block schematic diagram of the present disclosure.

DETAILED DESCRIPTION OF THE EXEMPLARY EMBODIMENTS

Referring to FIG. 1, which is a boost voltage driving device of the present disclosure. The boost voltage driving device is electrically connected to a light emitting device 100, and drives the light emitting device 100 to emit light, wherein the boost voltage driving device includes: an electric power supply module 1, outputting alternating current or direct current; a microcontroller 2, mounted on a circuit board 3 and electrically connected to the electric power supply module 1, wherein the microcontroller 2 further includes a control unit 21, an input unit 22 and an output unit 23, wherein the input unit 22 receives the alternating current from the electric power supply module 1 and adjusts, converts, or changes the voltage, pulse width, frequency of power; and the output unit 23 outputs the power adjusted, converted or changed by the control unit 21; a boost voltage module 4, mounted on the circuit board 3 and electrically connected to the electric power supply module 1 and the microcontroller 2, wherein the boost voltage module 4 includes a receive unit 41, a transmit unit 42 and a boost voltage control unit 43; wherein, the receive unit 41 receives the power from the output unit 23 of the microcontroller 2 or directly receives the direct current from the electric power supply module 1; wherein the duty cycle and bandwidth of the power are adjusted by the boost voltage control unit 43 to obtain a boosted voltage power 44, and the boosted voltage power 44 is transmitted to the light emitting device 100 by the transmit unit 42 and drives the light emitting device for emitting light; and a first feedback circuit 5 and a second feedback circuit 6, in which the first feedback circuit 5 serves as an electrical connection between the electric power supply module 1 and the microcontroller 2, and the second feedback circuit 6 serves as an electrical connection between the boost voltage module 4 and the microcontroller 2; when the electric power supply module 1 outputs alternating current, the power is transmitted to the first feedback circuit 5 to progress gain and distortion suppression, then transmitted to the microcontroller 2; when the electric power supply module 1 outputs direct current, the power directly is transmitted to the boost voltage module 4 and adjusted by the boost voltage module 43 to obtain the boosted power 44; wherein, part of the boosted power 44 is transmitted to the second feedback circuit 6 for gain and distortion suppression and then transmitted to the microcontroller 2, and part of the boosted power 44 drives the light emitting device 100.

Further, the electric power supply module 1 of the present disclosure includes a power supply member 11 and a battery supply member 12, so that the electric power supply module 1 can provide two types of power supply. Specifically, the power supply member 11 is electrically connected to the first feedback circuit 5, the battery supply member 12 is electrically connected to the microcontroller 2; the power supply member 11 supplies alternating current, and the battery supply member 12 supplies direct current; wherein the electric power supply module 1 outputs the power by either power supply member 11 or battery supply member 12. In brief, the battery supply member 12 can be dry cells, lithium batteries, etc. which supply direct current, and power supply member 11 can be utility power for supplying and transmitting alternating current.

As shown in FIG. 1, the present disclosure can be described into two pathways, the first pathway is that the power supply member 11 of the electric power supply module 1 outputs the power, the power is transmitted to the first feedback circuit 5 to suppress the distortion of the initial power and adjust the power bandwidth by the characteristic of the first feedback circuit 5. After that, the power is transmitted to the microcontroller 2, and adjusted, converted or changed by the control unit 21, and the adjusted, converted or changed power is transmitted to the boost voltage module 4 by the output unit 23, the power is boosted by the boost voltage module 4 to obtain a boosted power 44 with the optimal voltage, current, bandwidth and frequency that is suitable for the light emitting device 100, so that it prevents the excessive and redundant power supply from shortening the service life of the electric power supply module 1. During the boosted power 44 supplying and driving to the light emitting device 100, part of the boosted power 44 is divided and transmitted to the second feedback circuit 6, which has the same function as that of the first feedback circuit 5. The part of the boosted power 44 is adjusted and transmitted back to the microcontroller 2 for reuse. Through repeated use the power under the setting of the first pathway, the power supply and transmission of the power supply member 11 of the electric power supply module 1 can be optimally used.

Regarding to the second pathway of the present disclosure, when the power source is the battery supply member 12 of the electric power supply module 1, the power is transmitted to the boost voltage module 4 directly, and boosted by the boost voltage module 4 to obtain a boosted power 44; wherein, one part of the boosted power 44 supplies and drives the light emitting device 100, another part of the boosted power 44 is divided and transmitted to the second feedback circuit 6, and transmitted back to the microcontroller 2 for reuse. In other words, in the second pathway, the power source is the battery supply member 12 of the electric power supply module 1 with not large current and voltage, so that the power can be directly used for suppling and transmission after the boost adjustment by the boost voltage module 4.

It can be understood that in order to reduce the power loss of the battery supply member 12 of the electric power supply module 1 when suppling and transmitting the power, the microcontroller 2 of the present disclosure further includes a storage capacitor 24. After the power of the power supply member 11 is transmitted to the microcontroller 2 through the first feedback circuit 5, part of the power of the power supply member 11 is stored in the storage capacitor 24, and when the power is supplied only by the battery supply member 12, the storage capacitor 24 releases the power and supplies the battery supply member 12. Furthermore, the storage capacitor 24 provides the voltage value of the power from the output unit 23 of the microcontroller 2.

In addition, the power consumption occurs when the power supply member 11 of the electric power supply module 1 supplies the power and drives through the first feedback circuit 5 and the microcontroller 2. Therefore, in order to effectively reuse the power, a current amplifier 7 is provided and disposed on the circuit board 3. The control unit 21 of the microcontroller 2 transmits part of the power from the output unit 23 to the current amplifier 7, and the current amplifier 7 increases the power and transmits the power with the power from the power supply member 11 to the first feedback circuit 5 for adjusting. Through repeated integration and adjustment, the effective use of electricity can be achieved. Moreover, in the configuration of microcontroller 2, the output unit 23 further includes a D/A converter 231, a micro-control pulse-width modulation 232 and a boost pulse-width modulation 233, and the input unit 22 further includes two A/D converters 221. The two A/D converters 221 mainly receive the power from the first feedback circuit 5 and the second feedback circuit 6, and the power entering the two A/D converters 221 is an analog signal; the control unit 21 of the microcontroller 2 converts the analog signal into a digital signal, and adjusts, converts or changes the signal. Then the signal is transmitted to the elements in the output unit 23 for outputting the power to a suitable element through the D/A converter 231, the micro-control pulse-width modulation 232 and the boost pulse-width modulation 233. The D/A converter 231 and the micro-control pulse-width modulation 232 transmit part of the power to the current amplifier 7 for reuse, and part of the power is transmitted to the receive unit 41 of the boost voltage module 4 through the boost pulse-width modulation 233 for adjustment by the boost voltage control unit 43. After that, the power is transmitted to drive and operate the light emitting device 100, and meanwhile the power is also divided to the second feedback circuit 6 for reuse.

As to the microcontroller 2, in order to adjust, convert, or change the power supply of the electric power supply module 1, the microcontroller 2 further includes a detecting set 211 and an adjusting set 212. The detecting set 211 detects the voltage, current, frequency and bandwidth of the power supplied from the first feedback circuit 5 and the second feedback circuit 6 to the microcontroller 2, and the adjusting set 212 adjusts the result signal detected by the detecting set 211. After the adjustment, the adjusted signal is transmitted by the output unit 23. Through the repeated detection and adjustment of the microcontroller 2, the power for driving the light-emitting device 100 can be more precise and accurate, so that it prevents the battery supply member 12 of the electric power supply module 1 from excessive consumption in power supply, and provides the light-emitting element 100 with the optimal illumination.

What is claimed is:

1. A boost voltage driving device, electrically connected to a light emitting device, and driving the light emitting device, comprising:

an electric power supply module, outputting alternating current or direct current;

a microcontroller, mounted on a circuit board and electrically connected to the electric power supply module; wherein the microcontroller further includes: a control unit, an input unit and an output unit; wherein, the control unit receives the alternating current from the electric power supply module, the input unit adjusts, converts, or changes the voltage, pulse width, frequency of power and the output unit outputs the power from the control unit;

a boost voltage module, mounted on the circuit board and electrically connected to the electric power supply module and the microcontroller; wherein the boost voltage module includes: a receive unit, a transmit unit and a boost voltage control unit; wherein, the receive unit receives the power from the output unit and directly receives the direct current from the electric power supply module; wherein the power is adjusted by the boost voltage module to adjust the duty cycle and bandwidth to obtain a boosted voltage power, and the boosted power is transmitted to the light emitting device by the transmit unit and drives the light emitting device to emit light;

a first feedback circuit as an electrical connection between the electric power supply module and the microcontroller; and a second feedback circuit as an electrical connection between the boost voltage module and the microcontroller;

wherein, when the electric power supply module outputs alternating current, the power is transmitted to the first feedback circuit and progress gain and distortion suppression, then transmitted to the microcontroller;

wherein, when the electric power supply module outputs direct current, the power is directly transmitted to the boost voltage module and adjusted by the boost voltage module to obtain the boosted power, part of the boosted power is transmitted to the second feedback circuit for gain and distortion suppression and then transmitted to the microcontroller, and part of the boosted power drives the light emitting device.

2. The boost voltage driving device according to claim 1, wherein the electric power supply module further includes a power supply member and a battery supply member, in which the power supply member is electrically connected to the first feedback circuit, the battery supply member is electrically connected to the boost voltage module; wherein, the battery supply member supplies direct current, and the power supply member supplies alternating current; wherein, the electric power supply module outputs the power by either power supply member or battery supply member.

3. The boost voltage driving device according to claim 2, wherein when the power is supplied only by the power supply member, the microcontroller further includes a storage capacitor, after the power of the power supply member is transmitted to the microcontroller through the first feedback circuit, part of the power of the power supply member is stored in the storage capacitor; wherein when the power is supplied only by the battery supply member, the storage capacitor releases the power and supplies the battery supply member.

4. The boost voltage driving device according to claim 1, further includes a current amplifier disposed on the circuit board, wherein the control unit of the microcontroller transmits part of the power from the output unit to the current amplifier, and the current amplifier increases the power and transmits the power with the power from the power supply member to the first feedback circuit for adjusting.

5. The boost voltage driving device according to claim 4, wherein the output unit of the microcontroller further includes a D/A converter, a micro-control pulse-width modulation and a boost pulse-width modulation, and the input unit includes two A/D converters; wherein, part of the power is transmitted to the current amplifier by the D/A converter and the micro-control PWM terminal, and part of the power is transmitted to the receive unit of the boost voltage module by the boost PWM terminal.

6. The boost voltage driving device according to claim 1, wherein the control unit of the microcontroller further includes: a detecting set and an adjusting set, the detecting set detects the voltage, current, frequency, and bandwidth of the power supplied from the first feedback circuit and the second feedback circuit to the microcontroller, and the adjusting set adjusts the resulting signal detected by the detecting set, and then the adjusted signal is transmitted by the output unit.

* * * * *